US010753101B1

(12) United States Patent
Scanlan

(10) Patent No.: US 10,753,101 B1
(45) Date of Patent: Aug. 25, 2020

(54) ARTIFICIAL LIGHTWEIGHT STONE

(71) Applicant: Baton, LLC, Louisville, KY (US)

(72) Inventor: Tom Scanlan, Louisville, KY (US)

(73) Assignee: Baton, LLC, Louisville, KY (US)

( * ) Notice: Subject to any disclaimer, the term of this patent is extended or adjusted under 35 U.S.C. 154(b) by 0 days.

(21) Appl. No.: 15/836,252

(22) Filed: Dec. 8, 2017

Related U.S. Application Data

(60) Provisional application No. 62/432,159, filed on Dec. 9, 2016.

(51) Int. Cl.

| | |
|---|---|
| ***E04F 13/14*** | (2006.01) |
| ***E04C 2/04*** | (2006.01) |
| ***E04B 2/02*** | (2006.01) |
| ***E04B 2/72*** | (2006.01) |
| ***E04C 2/00*** | (2006.01) |

(52) U.S. Cl.
CPC ..... *E04F 13/147* (2013.01); *E04C 2/04* (2013.01); *E04B 2/72* (2013.01); *E04B 2002/0271* (2013.01); *E04C 2002/008* (2013.01)

(58) Field of Classification Search
CPC ... E04F 13/147; E04F 13/185; E04F 13/0862; E04F 13/0873; E04F 13/0733; E04C 2/04; E04C 2002/008; E04B 2/72; E04B 2002/0271
See application file for complete search history.

(56) References Cited

U.S. PATENT DOCUMENTS

| | | | | |
|---|---|---|---|---|
| 415,772 A | | 11/1889 | Fiske | |
| 451,572 A | | 5/1891 | Rankin, Jr. | |
| 1,728,461 A | | 9/1929 | Wolcott | |
| 1,857,995 A | | 5/1932 | Alles et al. | |
| 2,005,462 A | * | 6/1935 | Gibson | E04F 13/147 52/276 |
| 2,055,876 A | | 9/1936 | Newman | |
| 2,323,299 A | * | 7/1943 | Craig | E04F 13/147 428/161 |
| 2,577,215 A | | 12/1951 | Smith et al. | |
| 3,217,453 A | * | 11/1965 | Medow | E04F 13/185 52/314 |

(Continued)

FOREIGN PATENT DOCUMENTS

| | | |
|---|---|---|
| CN | 101508593 A | 8/2009 |
| DE | 8522733 | 11/1985 |

(Continued)

OTHER PUBLICATIONS

Korean Intellectual Property Office, Written Opinion in PCT/US2011/043523 dated Feb. 9, 2012, pp. 1-12.

(Continued)

*Primary Examiner* — Brian D Mattei
(74) *Attorney, Agent, or Firm* — Middleton Reutlinger

(57) ABSTRACT

A stone arrangement for a corner is provided which includes two stones for positioning at the corner, wherein one of the stones is provided with a curved corner and the second stone is provided with a sharp corner and wherein the stones have matching contours at a location where they abut so that the stones have improved aesthetic appearance. Further, the stones are formed to provide consistent dimensions when arranged at a corner so that stones extending further from the corner maintain intended dimensional tolerances.

20 Claims, 7 Drawing Sheets

(56) References Cited

U.S. PATENT DOCUMENTS

| | | | | |
|---|---|---|---|---|
| 3,524,790 | A | 8/1970 | Mason | |
| 4,043,826 | A | 8/1977 | Hum | |
| 4,306,395 | A | 12/1981 | Carpenter | |
| 4,572,699 | A | 2/1986 | Rinninger | |
| 4,734,322 | A | 3/1988 | Favre | |
| 4,761,095 | A | 8/1988 | Bartlechner | |
| 4,792,257 | A | 12/1988 | Rinninger | |
| 5,052,158 | A | 10/1991 | D'Luzansky | |
| 5,291,717 | A | 3/1994 | Turner | |
| 5,535,563 | A | 7/1996 | Brown et al. | |
| 5,671,583 | A | 9/1997 | Turner | |
| 5,768,829 | A | 6/1998 | Thompson et al. | |
| 5,819,486 | A * | 10/1998 | Goodings | E04F 13/0816 52/235 |
| 5,934,037 | A * | 8/1999 | Bundra | E04B 2/08 52/126.4 |
| 6,132,820 | A | 10/2000 | Callahan | |
| 6,286,285 | B1 | 9/2001 | Martell | |
| 6,296,699 | B1 | 10/2001 | Jin | |
| 6,355,193 | B1 | 3/2002 | Stott | |
| 6,616,752 | B1 | 9/2003 | Basura et al. | |
| 6,848,224 | B2 | 2/2005 | Bailey | |
| 6,944,998 | B1 * | 9/2005 | King | B44F 9/04 52/314 |
| 7,489,984 | B2 | 2/2009 | Jackman et al. | |
| 7,712,262 | B2 | 5/2010 | Scanlan | |
| 7,774,091 | B2 | 8/2010 | Jackman | |
| 8,413,397 | B2 | 4/2013 | Lacas et al. | |
| 8,454,742 | B2 | 6/2013 | Scanlan | |
| 8,820,022 | B1 | 9/2014 | Riccobene et al. | |
| 8,926,873 | B2 | 1/2015 | Scanlan | |
| 9,034,094 | B2 | 5/2015 | Scanlan | |
| 9,388,571 | B2 | 7/2016 | Brown et al. | |
| 9,404,226 | B2 | 8/2016 | Dignard et al. | |
| 9,677,283 | B2 * | 6/2017 | Attebery, II | E04F 13/007 |
| 10,035,730 | B2 | 7/2018 | Scanlan | |
| 2002/0106504 | A1 | 8/2002 | Stott | |
| 2002/0152704 | A1 | 10/2002 | Thompson et al. | |
| 2003/0087046 | A1 | 5/2003 | Carpenter | |
| 2003/0200713 | A1 | 10/2003 | McStay | |
| 2004/0006943 | A1 | 1/2004 | Weick | |
| 2004/0070106 | A1 | 4/2004 | Harrington | |
| 2005/0087908 | A1 | 4/2005 | Nasr et al. | |
| 2005/0217175 | A1 | 10/2005 | Leone et al. | |
| 2005/0229500 | A1 | 10/2005 | Howard | |
| 2005/0252144 | A1 | 11/2005 | MacDonald et al. | |
| 2005/0252146 | A1 * | 11/2005 | MacDonald | E04C 1/395 52/606 |
| 2005/0268569 | A1 | 12/2005 | Teodorovich | |
| 2006/0156668 | A1 | 7/2006 | Nasvik | |
| 2006/0217464 | A1 | 9/2006 | Guevara et al. | |
| 2006/0260230 | A1 | 11/2006 | LeBlanc et al. | |
| 2006/0277840 | A1 | 12/2006 | Bailey | |
| 2007/0130860 | A1 | 6/2007 | Paquette et al. | |
| 2008/0095584 | A1 | 4/2008 | Strand et al. | |
| 2008/0110116 | A1 * | 5/2008 | Brown | E04C 1/395 52/315 |
| 2008/0275149 | A1 | 11/2008 | Ladely et al. | |
| 2008/0313988 | A1 | 12/2008 | MacDonald | |
| 2009/0056257 | A1 * | 3/2009 | Mollinger | B29C 37/0032 52/314 |
| 2009/0077920 | A1 * | 3/2009 | Korman | B29C 43/06 52/606 |
| 2009/0126301 | A1 * | 5/2009 | Brown | B44F 9/04 52/314 |
| 2010/0197182 | A1 | 8/2010 | Barzilai | |
| 2010/0263310 | A1 * | 10/2010 | Wauhop | B28B 17/0018 52/250 |
| 2011/0265418 | A1 * | 11/2011 | Wolter | E04C 1/395 52/561 |
| 2011/0289877 | A1 * | 12/2011 | Correia | E04F 13/0851 52/309.4 |
| 2013/0122234 | A1 * | 5/2013 | Gremion | B32B 3/06 428/44 |
| 2013/0145968 | A1 * | 6/2013 | Scanlan | C04B 32/00 106/676 |
| 2014/0041331 | A1 * | 2/2014 | Buoni | E04F 13/0733 52/506.01 |
| 2014/0170365 | A1 * | 6/2014 | Gavris | E04F 13/0876 428/71 |
| 2014/0182225 | A1 * | 7/2014 | Wilkie | E04F 13/0835 52/302.1 |
| 2014/0272449 | A1 | 9/2014 | Macdonald et al. | |
| 2016/0108623 | A1 * | 4/2016 | Attebery, II | E04F 13/007 52/302.1 |
| 2017/0342722 | A1 * | 11/2017 | Attebery, II | E04F 13/24 |

FOREIGN PATENT DOCUMENTS

| | | | |
|---|---|---|---|
| DE | 19800408 | | 7/1999 |
| DE | 10200033365 | | 2/2012 |
| EP | 0053456 | A2 | 6/1982 |
| JP | 11081624 | A | 3/1999 |
| WO | 1994015025 | | 7/1994 |
| WO | 2013076115 | | 5/2013 |

OTHER PUBLICATIONS

Camillo, Jim; Device Duplicates Stone Shapes. (new products); Masonry Construction Publication Oct. 1, 2002.

Slag Cement Association (SCA)—"What is the difference between slag cement and slag aggregate?"—Slag Cement Creates Concrete at Its Best; www.slagcement.org/news/FAQ_difference.html; Feb. 2013 Feb. 1, 2013.

* cited by examiner

ARTIFICIAL LIGHTWEIGHT STONE

CLAIM TO PRIORITY

This non-provisional patent application claims priority to and benefit of, under 35 U.S.C. § 119 (e), U.S. Provisional Patent Application Ser. No. 62/432,159, filed Dec. 9, 2016, and titled "Artificial Lightweight Stone", all of which is incorporated by reference herein.

BACKGROUND

1. Field of the Invention

Present embodiments relate to an artificial lightweight stone. More specifically, present embodiments relate to a stone system of artificial stone blocks each formed of cement and at least one of expanded polystyrene or expanded glass wherein which have consistent contours about a corner and which also provide a consistent measurement for a series of stone with mathematical relationships extending in a length-wise direction.

2. Description of the Related Art

Traditional stone or manmade stone walls are assembled together in the shape of a wall and typically held together with mortar or with grout between the stones. A wall behind the stone also typically requires a lath material which must be coated with mortar as well. The mortar and lath materials are required due to the weight of the stone or manmade stone which ultimately adds expense and time to jobs. The mortar and lath may also nullify the effects of the structural movement of the building.

Various attempts have been made to use manmade materials which are less expensive and require less labor. Some materials are formed in preformed sheet like structures which are applied to a wall desired to have a stone like faced. However, these preformed sheets or structures do not allow for variation of dimension of the wall. Alternatively stated, these preformed sheets limit dimensional changes of a wall only to some dimension which is a multiple of the base dimension of a single sheet unit. Further when the preformed sheet needs to be cut, this adds difficulty to the project.

Other designs have been used, such as stamped concrete or textured concrete. However, concrete material is extremely heavy and therefore requires additional structure to support the weight of such concrete. Other materials have been formed in an attempt to provide a rock or stone like appearance, however such materials do not appear completely realistic and therefore have not been widely accepted.

Still further, the problem has arisen that the stones must be arranged about a corner. The arrangement of stones often results in two issues. Sometimes, the stones that extend about the corner are sometimes formed to extend through the 90 degree turn. These type stones require an alternate molding process due to the substantially differing depth from the remainder of stones. These stones are difficult to make and more expense per unit both for materials and labor. The molds for these stones are more expensive and the manufacturing time is increased. Moreover, manufacturing consistency varies more whether it be color, dimension or other features.

A second issue is related to dimensional changes of the stones. In normal construction at a corner location, the stones may require cutting in order to provide a proper configuration at the corner. However, for stone systems which are manufactured based on a multiple of some dimension, changing the dimension of one stone, by cutting, may vary the dimension of the series of stones extending from the corner outward. This is problematic if stones are designed with preselected sizes as part of a system.

It would be desirable to overcome these and other deficiencies known in the prior art and provide a lightweight stone like material which may be used at corners locations, and which has improved aesthetics of the stone arrangement at that location, as well as improves manufacturing of such stone while also reducing costs. Additionally, it would be desirable to limit the cutting or otherwise variation of the related stones in the wall so that dimensional changes to a length-wise run of stones are limited or otherwise precluded based on the arrangement at the corner.

The information included in this Background section of the specification, including any references cited herein and any description or discussion thereof, is included for technical reference purposes only and is not to be regarded subject matter by which the scope of the invention is to be bound.

SUMMARY

A stone arrangement for a corner is provided which includes two stones for positioning at the corner, wherein one of the stones is provided with a curved corner and the second stone is provided with a sharp corner and wherein the stones have matching contours at a location where they abut so that the stones have pleasing aesthetic appearance. Further, the stones are formed to provide consistent dimensions when arranged at a corner so that stones extending further from the corner maintain intended dimensional tolerances with only limited or no cutting required.

According to some embodiments an artificial lightweight stone corner assembly comprises a first lightweight molded stone having at least one first face which has a natural stone appearance and a first abutting corner end, a second lightweight molded stone having at least one second face which has a natural stone appearance and a second abutting corner end, the two abutting corner ends having matching contours and one of the two opposing corner ends being a transition corner, the two lightweight molded stones abutting one another at the first and second abutting corner ends, the natural stone appearance having substantially matching contours.

According to some optional embodiments, the following may be used independently with the previous embodiment or in combination with one or more of the other optional embodiments and the previous embodiment.

In some embodiments, the transition corner may be one of round, beveled or chamfered.

In some embodiments, the abutting corner end may have substantially matching edges.

In some embodiments, the abutting lightweight molded stones may define an inside corner at rear surfaces of the abutting lightweight molded stones.

In some embodiments, the first stone may have a first dimension from the inside corner to an end of the first stone.

In some embodiments, the second stone may have a second dimension from the inside corner to an end of the second stone.

In some embodiments, the first dimension and the second dimension may be a preselected base number or a multiple of said base number.

In some embodiments, the first and second stones each having an edge with the matching contours at the abutting corner ends.

In some embodiments, the artificial lightweight stone may further comprise at least two rows of stones, wherein at least one first and second stones on the first row and a third stone on the second row, at least one of said first and second stones and the third stone having a length differential which is a base number or a multiple of the base number.

According to some other embodiments an artificial lightweight stone assembly may comprise a first faux lightweight stone having a face with a natural stone appearance, the face having a first corner end, a second faux lightweight stone having a second face with a natural stone appearance, the second face having a second corner end with matching contour as the first corner end, wherein one of the first corner end and the second corner end is a transition corner, further wherein when the first corner end of the first faux stone abuts with the second corner end of the second faux stone, the contours of the corner ends are aligned at an intersection.

In some embodiments, the assembly may further comprise at least two rows of stones.

In some embodiments at least one of the first and second stones on said first row and a third stone on said second row.

In some embodiments, at least one of said first and second stones and said third stone having a length differential which is a base number or a multiple of said base number.

In some embodiments, the assembly may further comprise a fourth stone having a height which is at least a height of the sum of said at least two rows.

In some embodiments, the at least two rows may have at least one location where a vertical edge is formed by two stones of said at least two rows.

In some embodiments, the fourth stone located at the vertical edge.

In some embodiments, the assembly may further comprising an adhesive which may or may not contain cement.

According to a method of installing an artificial lightweight stone at a corner comprises providing a first artificial lightweight stone having a transition corner, the transition corner having a contour, providing a second artificial lightweight stone having an corner end which matches the contour of the transition corner of the first artificial lightweight stone, positioning the second artificial lightweight stone at the substrate corner, positioning the first artificial lightweight stone at a substrate corner wherein the transition corner extends at least partially beyond the substrate corner and aligns with an edge the said second artificial lightweight stone, abutting the second artificial lightweight stone with the transition corner of the first artificial lightweight stone.

Optionally, the method may further comprise aligning an edge of the transition corner and an edge of the corner end.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of an artificial lightweight stone will now be described by way of examples. These embodiments are not to limit the scope of the claims as other embodiments of an artificial lightweight stone will become apparent to one having ordinary skill in the art upon reading the instant description. Non-limiting examples of the present embodiments are shown in figures wherein:

DETAILED DESCRIPTION

Figure 1:
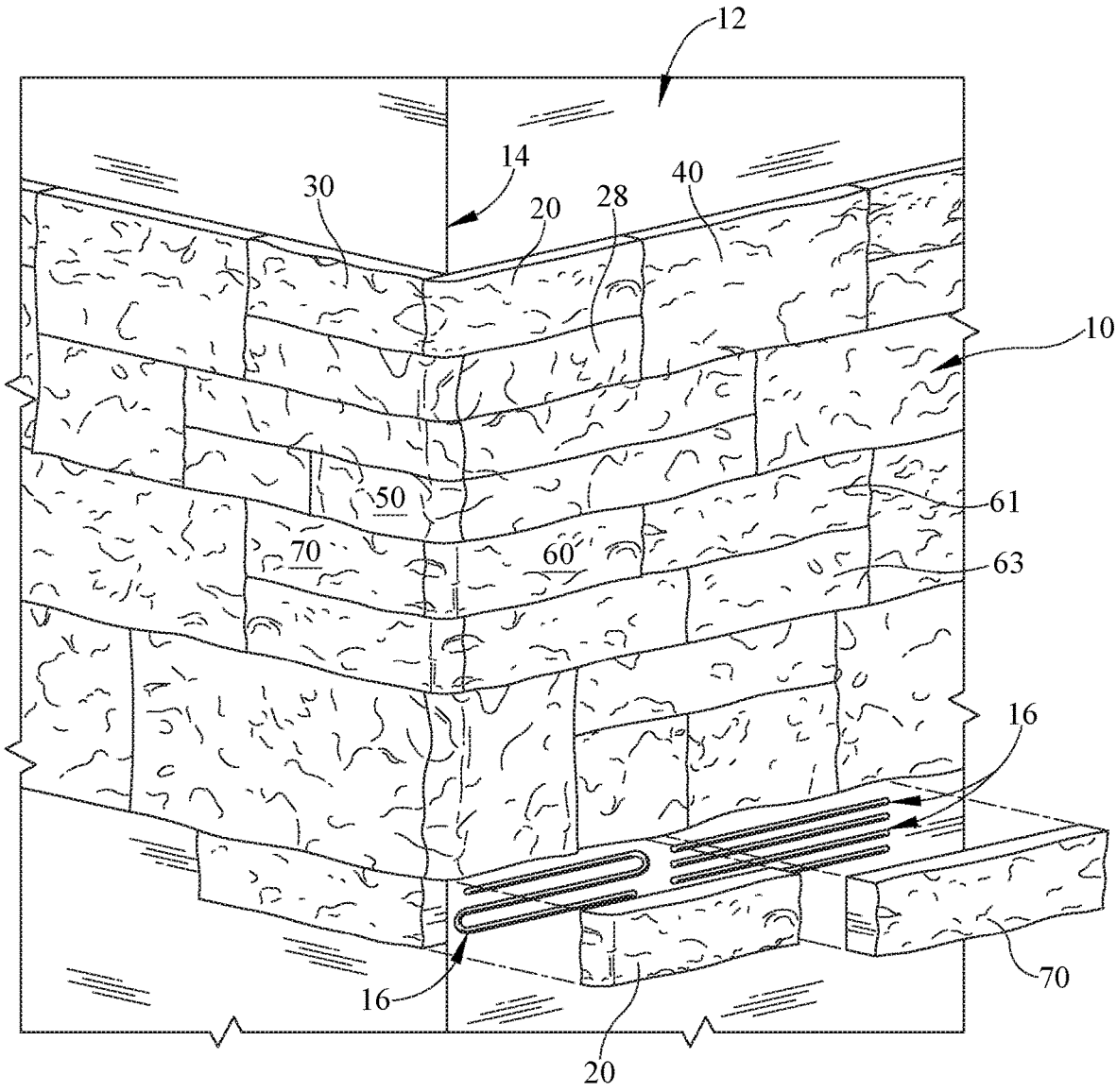
FIG. 1 is a perspective view of a wall at a corner and a plurality of artificial stones covering the wall.

It is to be understood that an artificial lightweight stone is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the drawings, wherein like numerals indicate like elements throughout several views, there are shown in FIGS. 1-7 embodiments of an artificial lightweight stone. An artificial stone arrangement for a corner is provided which improves manufacturing of stones for the corner and has pleasing aesthetic appearance with improved costs and manufacturing benefits. The stones disposed at the corner are arranged so that seams have substantially matching contours and so that the exposed surfaces are matching, as opposed to cut faces which may differ in appearance from the stone finish/appearance. As a result, the corner arrangement of stones may also be placed with consistent dimensional results extending from the corner along a wall. Thus, fewer cuts are needed and dimensions stay consistent.

Referring now to FIG. 1, an artificial lightweight stone wall 10 is shown. The stone wall or veneer 10 is formed of a plurality of individual stones. With respect to this disclosure, the term "stone" or "block" is meant to include artificial stones or blocks. Each of the stones are formed having at least two preselected dimensions so as to provide a system requiring minimal cutting to cover wall structures of various sizes while providing a straight edge at ends of a wall 12. The wall 12 is a base structure which may be formed of various substrate materials including wood, drywall, MDF, rigid insulation boards, lightweight plastics or any suitable planar materials to which the artificial stone veneer 10 may be adhered and which may or may not be common with building practices.

The artificial stone may be formed of cement, water and optionally, at least one of styrene or expanded glass. Additionally, the individual stones may include a natural or manufactured aggregate such as, without limitation, concrete, sand, expanded clay, shale, slate, sintered fly ash, perilite, vermiculite, pumice, scoria, tuff, or other filler materials, components or composites. The styrene may comprise, without limitation, styrene, polystyrene, and expanded polystyrene (EPS) to provide a lightweight artificial stone which is capable of being mounted on a wall structure without the necessity of a lath or mortar. The expanded glass may be porous glass spheres or micro-cell glass spheres made from 99.997% pure glass from, for example, recycled sources. Alternatively, the expanded glass may come in other forms including beads, shards, three-dimensional polygons or other shapes, and may be utilized with or without the styrene. Due to the molding of dimensionally accurate stones, and the use of a dimensional system, the stones may be closely spaced, substantially without gaps, in a fashion not requiring mortar between the stones. This is sometimes referred to as dry-laid stacking.

The wall 12 is shown having a corner 14 so that the artificial stone veneer 10 is laid about the corner 14. The figure depicts artificial stone wall 10 formed of a plurality of artificial stones 20, 30, 40, 50, 60 and 70, with at least one of the stones exploded from the wall 10 to reveal a substrate wall 12 behind the artificial stone wall 10. Behind the exploded stones 20 and 70, a fixative 16 is disposed which is utilized to adhere the stones to the substrate or wall 12. The fixative 16 may be applied in various patterns and is shown in one long turning application or multiple strip applications. When the wall 12 is constructed indoors, the adhesive 16 may be some cement-free type of adhesive or fixative. For example, the fixative material commercially referred to as "Liquid Nail" may be utilized in one non-limiting example. Alternatively, acrylic-based, silicone-based or other pre-mixed adhesives may be utilized, or the adhesive could be a premixed cement based adhesive. However, such adhesives should not be considered limiting as any cement-free pre-mixed adhesive or fixative may be utilized. In a further alternative, if the wall 12 is positioned on an outside surface, it may be desirable to utilize a non-premixed cement or outdoor construction adhesive since the destructive effects of ultraviolet light will not cause degradation of the cement based mortar or adhesive. Additionally, if utilized outside, since a cement based adhesive or a mortar are utilized, the construction may or may not also require a lath. In a further alternative, when utilized to form an exterior surface, a fixative or adhesive 16 may also be disposed between the stones to seal any spaces between stones so that rain or other weather elements are inhibited from accessing the substrate behind the artificial stones. Generally, indoor applications may utilize water-based fixatives and mortars which may or may not be pre-mixed but may also be made from cement. Alternatively, outdoor applications may require cement-based construction fixative or adhesives to limit water damage. Whether used interiorly or exteriorly, the rear surface of the artificial stones may be smooth surfaced or may be slightly textured to improve adherence of the stones to the substrate 12. It may also be desirable and is assumed that the adhesive, whatever type, is provided with a consistent thickness on the substrate or wall 12.

The stones 20, 30, 40, 50, 60, 70 defining the veneer 10 may be formed or cut into a series of sizes which provide various advantages. First, the stones are dimensioned to provide a straight line along outer edges of the artificial stone wall 10 thereby minimizing cutting of the stones. Second, the stones have straight edges and smooth surfaces allowing tight placement of adjacent stones. Further, the dimensional accuracy of the artificial stones provides that no grout or mortar joints are required between adjacent stones and so that substrate is not seen. Although mortar or grout joints may be used if desired by the end user or installer. Additionally, due to lightweight composition of the stones, the stones may be applied to the substrate wall 12 without additional structural reinforcement. Instead, a lightweight fixative 16, for example a pre-mixed fixative, may be used which allows for easier installation. Still further, some of the artificial stones are formed to be laid about a corner 14 of the wall or substrate 12. Once laid about the corner 14, the stones 20, 30, 40, 50, 60, 70 maintain their dimensional relationship so that the arrangement of stones in a lateral direction away from the corner 14 is maintained. Further, unsightly seams between stones are also minimized without requiring a single stone to extend about the entire corner. However, mortar and grout seams may be utilized if desired and therefore are not excluded from the scope of claims.

Figure 2:
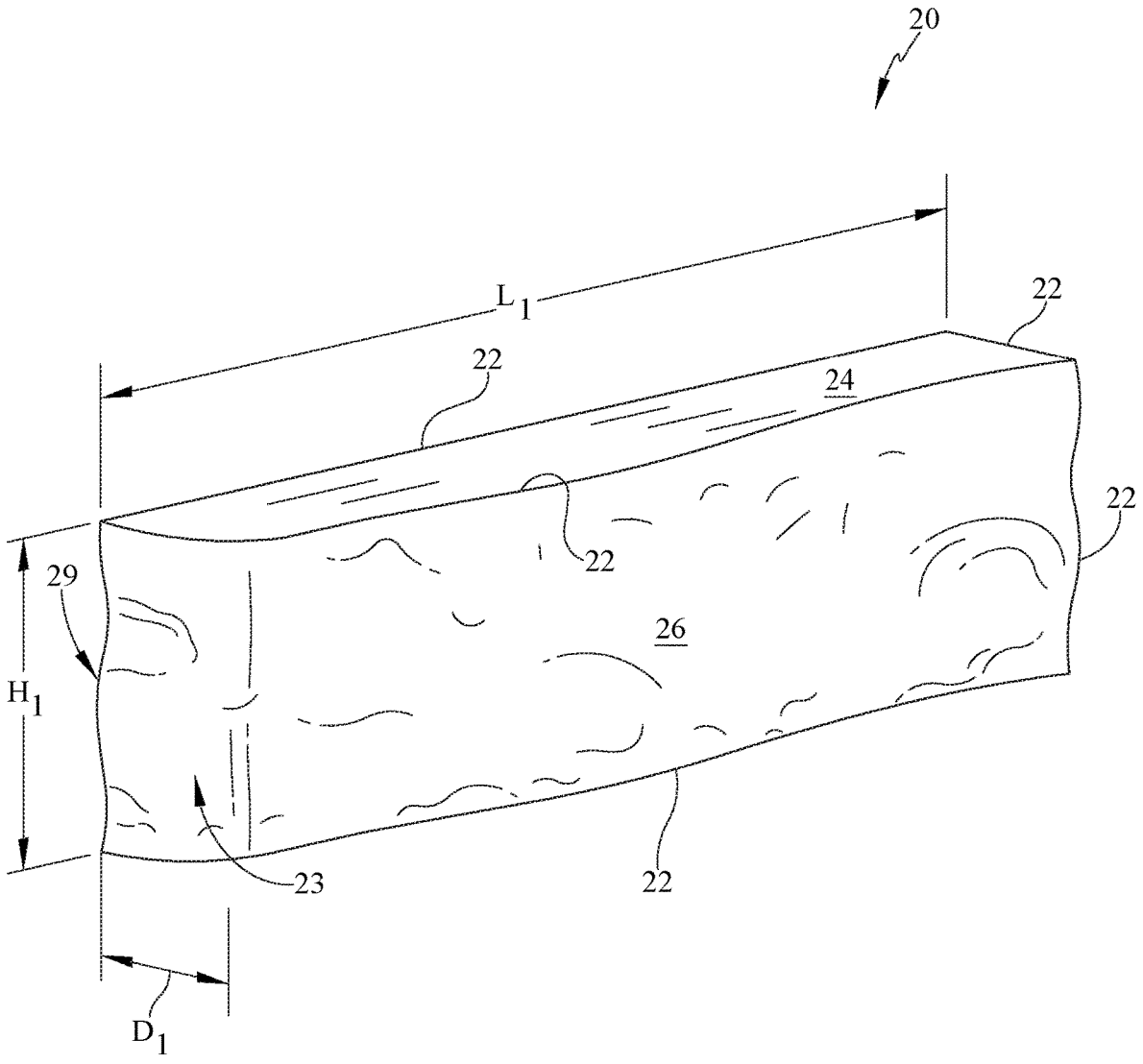
FIG. 2 is a perspective view of one of the corner stones having a rounded corner end.
Figure 3:
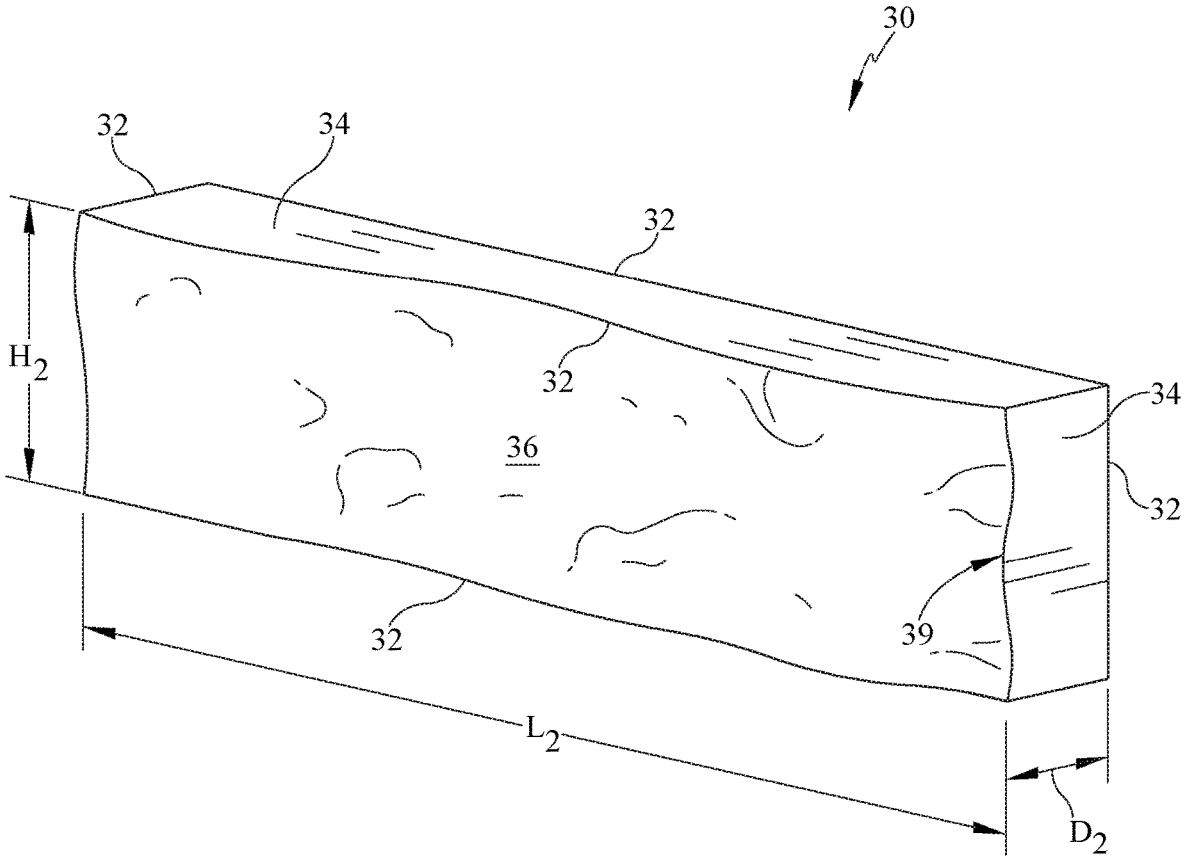
FIG. 3 is a perspective view of another of the corner stones having a sharp corner end.

The stones 20, 30, 40, 50, 60 and 70 may be laid in various patterns. In the instant pattern, the dimension of the blocks is of some importance so that the total length dimension of any combination of stones laid laterally, or horizontally, is some preselected multiple of a number, for non-limiting example a multiple of the number two inches (2"). Additionally, or alternatively, a differential between lengths of adjacent stones of an adjacent row may be some base number or a multiple of the base number, for non-limiting example two (2") inches. This number may be a whole number or may be a fractional number. The vertical dimensions of the stones may be the same or may differ and according to the depicted embodiment differ but are based on a base number or multiples thereof, for non-limiting example two inches. Two exemplary blocks are shown in FIGS. 2-3 but should not be considered limiting as various numbers of blocks may be formed, which may be of various non-limiting shapes and dimensions.

In order to provide this straight boundary edge, the stones 20, 30, 40, 50, 60, and 70 are each provided with dimensional relationships. Each of the stones 20, 30, 40, 50, 60 and 70 define the wall 10 at corner 14 are depicted. With reference now to FIG. 2, an example of one of the stones 20 is depicted in perspective view. The stone 20 has a height ($H_1$), a length ($L_1$) and depth ($D_1$) dimension. The height dimension is measured generally in a direction perpendicular to the floor and parallel to substrate 12 (FIG. 1). The width dimension is measured in a direction which is substantially parallel to the floor and parallel to the substrate 12 (FIG. 1). The depth dimension is measured in a direction which is generally parallel to the floor and perpendicular to substrate 12 (FIG. 1). Each of the height and width dimensions are either a base number, for example two, or an integer multiple of that base number. For example, the height ($H_1$) may be two inches (2") or the height may be 4". Similarly, the length ($L_1$) may also be a base number, or some integer multiple of that base number. The use of a base number and an integer multiple provides that the stones may be arranged to provide an artificial stone wall 10 having a dimensional border with a substantially straight line. Further, the use of the stone 20 as the base dimension is merely exemplary as any one or more of the stones used in the system may serve to provide the base dimension upon which others are formed. As previously discussed, the wall system 10 utilizes flat-stacked stones which do not utilize mortar between joints. Prior art systems utilize mortar to fill gaps in both the horizontal and vertical directions. One problem with such vertically extending mortar is that dimensional inaccuracies become skewed across the width of a wall because the mortar widths may vary and those width variations accumulate across an entire width of a wall. Additionally, natural and existing man-made stones are not accurate dimensionally and mortar is used horizontally to compensate for the imprecise nature of these stone sizes in order to level a row of stones. With respect to the instant system, the accuracy of the stone dimensions results in a lack of need to fill gaps and compensate with mortar between stones. Additionally, when forming the artificial stone wall 10, the preclusion of gaps makes easy the sizing of stones in order to form a wall with aligned edges since installers do not have to compensate for the thickness or width of the mortar. Due to the standard size, pattern and ninety degrees (90°) corners of each stone, the stones fit together snugly thus eliminating gaps that would otherwise reveal the supporting wall 12. Therefore no grouting is required to complete the finished appearance.

Additionally, since the height $H_1$ and length $L_1$ utilize a base number or a multiple of that base number, the stones may be oriented so that a longest dimension is either vertical or horizontal in the pattern. This provides artistic expression, but also a desired seemingly disorderly and more natural appearing organization of the artificial lightweight stone wall 10.

The stone 20 also includes a plurality of edges 22 which are defined by substantially perpendicular corners. Theses edges 22 extend in a depth direction and a length direction. A plurality of smooth surfaces 24 are defined extending from the rear of the stone to a front surface 26. Each of the surfaces 24, adjacent to and defining the edges or corners 22, are smooth, except for the front surface 26, which may have a natural stone finish and appearance. The smooth surfaces 24 provide that adjacent stones may be flushly abutted to minimize gaps there between. As previously indicated this eliminates the need for use of mortar between stones which inhibits viewing of the substrate 12 behind the stones. Additionally, the flush abutment of stones also precludes visibility of the substrate wall 12 behind the stone wall system 10. The depth of the stones may range from about ¼" inch to about 4" inches. More specifically, the depth may be about ¼" to about 1½". These thicknesses are fairly consistent and vary only due to the contouring and texturing of the outer stone faces. The stone dimensions are all desired to have a tolerance of about +/−1/16". However, if mortar or grout is utilized, then surfaces 24 need not be smooth. Likewise, the length dimension $L_1$ need not be as precise. Accordingly, a more naturally appearing surface may be utilized along these surfaces and dimensions.

The stone 20 also includes a front surface or natural face 26 which may be smooth or textured or may simulate the natural face of a stone. The surface 26 may also be flat or may have contouring variation in the end thickness, in addition to the texturing which may or may not be present. The variation in thickness provides a more natural stone-like appearance for the visible surface of the wall system 10. The depicted stone 20 has a contour to provide a natural stone appearance on the front surface 26 providing the stone 20 a more natural look.

Figure 4:
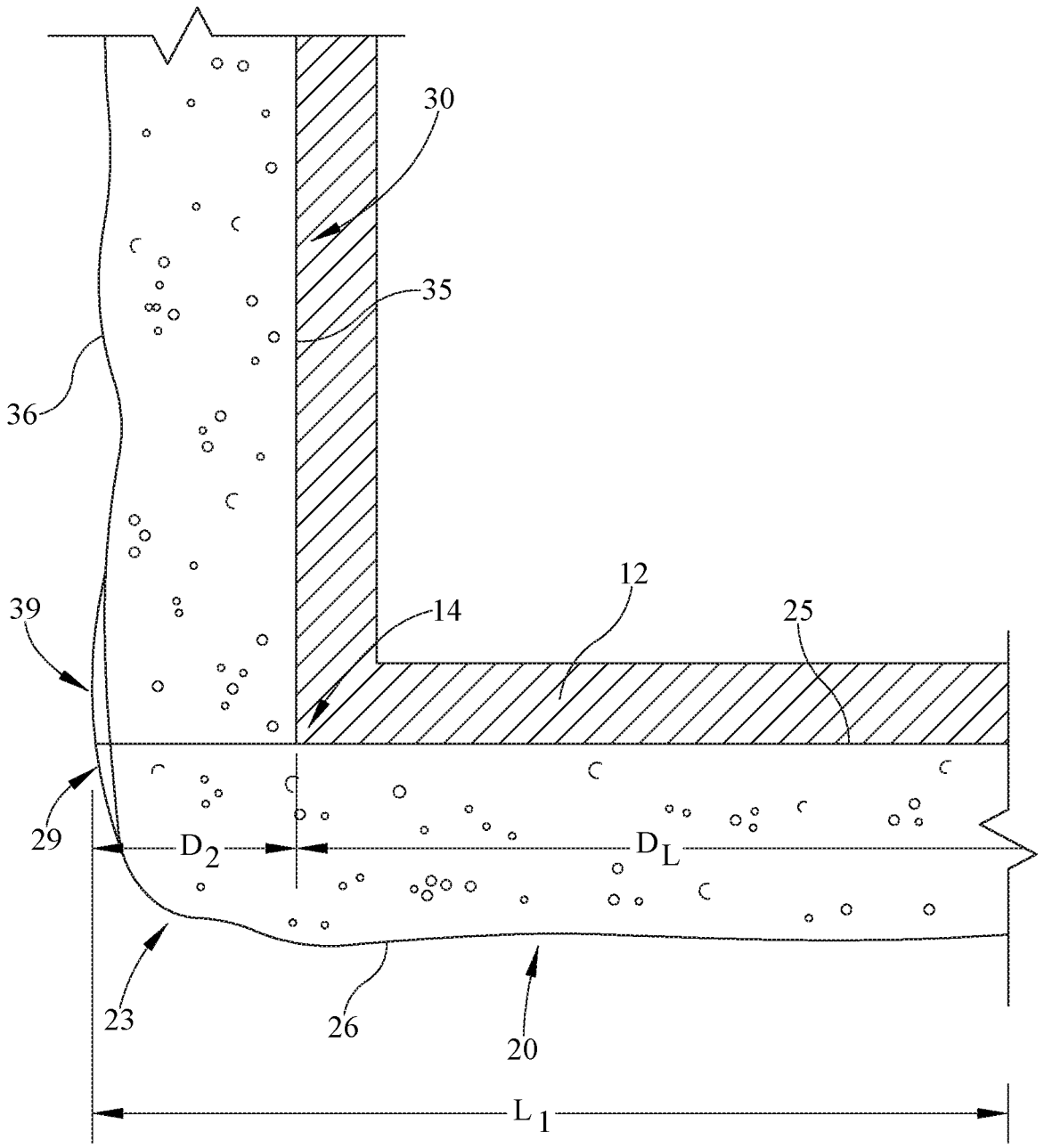
FIG. 4 is a top view of the corner location depicting the surface contours from one direction.

The stone 20 also comprises an abutting corner 29 which may abut another stone at a corner and the abutting corner defines a transition corner 23 which extends to join the front surface 26 to one of the side surfaces 24 at or near corner 29. The surface of corner 23 may be a natural stone finish like surface 26. The transition corner 23 may be round, beveled or chamfered transition from the front to the side surface 24 of the stone 20 or alternatively, considered to extend from the front surface 26 to a rear surface 25 (FIG. 4). The transition corner 23 includes the substantially natural stone appearance up to the edge of the stone 20 which abuts the adjacent stone 30 (FIG. 4). The end or corner end of the stone 20 adjacent to the transition corner 23 may also have some contour, such as a jagged-edge, similar to a natural stone and which substantially matches the edge of the adjacent stone 30 at the corner 14 (FIG. 4). The stone 20 may also may overlap a corner 14 of the substrate 12, or at least curves to an edge which is generally flush with the surface to which stone 20 is attached. At this location, the adjacent stone 30 may abut the stone 20. The transition corner 23 has a surface which has contours and/or texturing similar to surface 26 for a natural stone appearance. The stone 20 has a rear surface 25 with a substantially consistent flat surface and does not have a step or change in the depth at the rear surface as sometimes required to reach around the corner 14 of wall 12.

Referring now to FIG. 3, an additional stone or block 30 is shown in perspective view. The stone 30 has a plurality of edges 32 defined by surfaces 34. The surfaces 34 are substantially smooth for abutting adjacent stones. Specifically, at least one of the surfaces 34 has a smooth finish which abuts or engages the rear surface or side of stone 20 (FIG. 2) in the area of the transition corner 23 (FIG. 2). This area of stone 30 may also be considered to be an abutting corner 39 which is abutted by the abutting corner 29 of stone 20, specifically at the rear area of the transition corner 23. The stone 30 further comprises a front surface 36 which may be smooth, textured or have a variable thickness in combination with the smooth or textured surface. The contours at interface of the front surface 36 and the vertical surface 34 provide a desirable aesthetic finish and matches that of stone 20 and surface of transition corner 23.

The edges 32 of the stone 30 are substantially perpendicularly formed and may extend in the depth direction $D_2$ and/or the length direction $L_2$. The substantially ninety degrees edges in combination with flat surfaces provide for a substantially gap-free or a minimized gap design between adjacent stones.

The stone 30 also comprises a height dimension $H_2$, a length dimension $L_2$, and a depth dimension $D_2$. The length and the height dimensions are either a base number or a multiple of that base number as previously mentioned with stone 20. In this example, the height $H_2$ may be equal to $L_1$ or may be a multiple of $H_1$, for example twice the height of $H_1$. Similarly, for example, the length $L_2$ may be substantially equal to or some multiple of $L_1$. Additionally, it should be noted that the stones may be rotated about an axis extending through surface 36 in the depth direction by about 90 degrees. In such configuration, the height dimension $H_2$ would become the width and the width $W_2$ would become the height. Such orientation may be utilized with the generally square shaped block 30 but also generally rectangular shaped stones.

The depth $D_2$ is generally equal to the depth $D_1$ and may be, according to some embodiments, between about one-quarter (¼") inch and about four (4") inches. This range provides for a block size which provides a consistent depth along the front surface of the veneer wall 10 (FIG. 1) and may be supported along a wall surface 12.

As previously mentioned, the transition corner 23 may extend beyond a corner 14 of wall 12. In the area where the transition corner 23 extends from the wall 12 at the corner 14, the stone 30 is positioned to engage the stone 20. One advantage of this arrangement is that the stones may be formed of preselected lengths. Further, since the stone lengths are preselected, and may be abutted in a repeatable manner, the stone lengths measured from an inside corner of the abutting stones 20, 30, at corner 14 is consistent. With this dimension being consistent, the consistent dimensioning of a series of stones may be maintained at the desired integer multiple precluding the need to make cuts or in the least, eliminating the need for as many cuts of the stones.

An additional advantage of the present embodiment is provided by the close abutment of the stones 20, 30 (FIG. 4) without the need for mortar. The transition corner 23 has a surface which is consistent with the contours and/or texture of surface 26, as well as the front surface 36 at surface 34 of stone 30. Since the transition corner 23 is close to the stone 30, the matching contours 29, 39 (FIG. 4) provide a blended improved appearance and the seam 42 (FIG. 6) between stones 20, 30 is less prominent.

Referring now to FIG. 4, a top view of a corner arrangement of stones 20, 30 is shown. The stone 20 includes the transition area 23 wherein the stone 30 abuts stone 20. As depicted, the rear surface 25 and the rear surface 35 form an inside corner, corresponding to corner 14, where a measurement may be taken along either stone 20, 30. Since the stones 20, 30 have matching surface contours along at least portions of surfaces 26, 36, the exterior contours may be aligned so that seam contours 29, 39 are aligned on the front surfaces 26, 36. When this is done, the dimension from the inside corner of the stones 20, 30 is measureable from an inside corner toward ends of the stones and is a consistent repeatable dimension that is in agreement with the remainder of stones at least in a length direction so as to be consistent with the dimensioning of the group of stones and the preselected dimension or multiple thereof.

Figure 5:
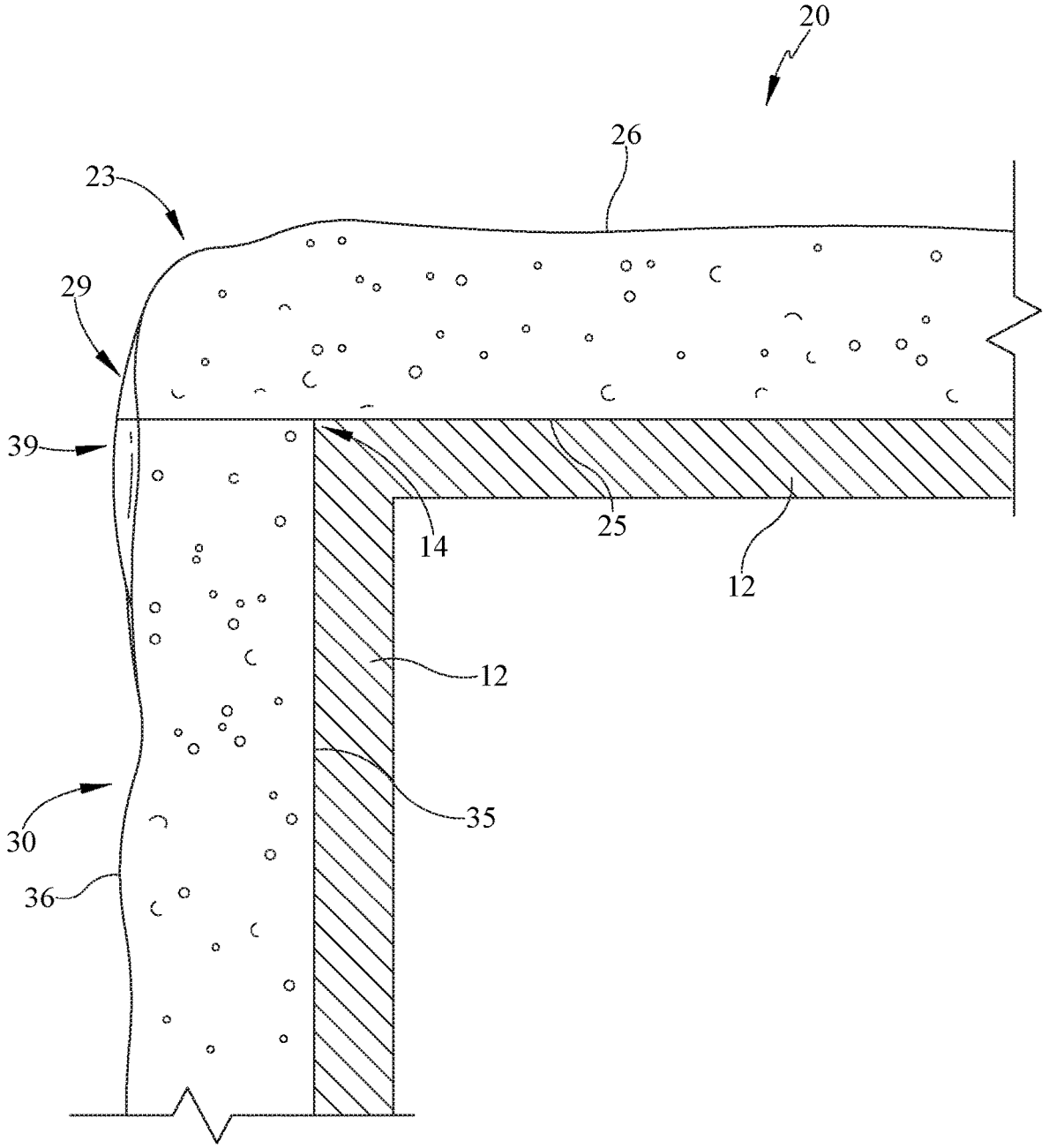
FIG. 5 is a bottom view of the corner location depicting the surface contours from a second direction parallel to the direction of FIG. 4.

Also shown in FIG. 4 is the surface contour of the front surface 26 of stone 20. The transition corner 23 may be curved as shown, or angled and further has an edge or corner end 29 with a contour, for example a jagged-edge. The transition corner 23 may also maintain same or similar contours of the front surface 26 to provide a stone like appearance up to the edge or corner end 29 of the stone 20. The corner end or edge 29 of transition corner 23, matches an abutting edge 39 of surface 36, which has a sharp corner rather than curved or angled. Likewise, as shown in the Figure, the stone 30 also has a matching contour to that of transition corner 23 at least at abutting edges 29, 39. The contours of edges 29, 39 are matching in shape rather than being of differing shapes that do not match when the stones 20, 30 are abutting. This is desirable and as shown, at the seam or abutting location of the stones 20, 30. This is clear when viewing the stones 20, 30 from above as shown in FIG. 4, from below as shown in FIG. 5 and/or along a surface 26, 36 of either stone 20, 30.

It should be understood that this description assumes a consistent thickness of adhesive between the stones 20, 30 and the substrate 12. If this adhesive varies significantly in thickness, the dimensional relationship of the stones may be altered at the corner, which may be detrimental to down row stones. Also, although some embodiments may not utilize mortar or grout seams, it is within the scope of the instant embodiments that other embodiments may include mortar and grout seams, if desired.

With reference still to FIG. 4, a dimensional relationship may also be described with the stones 20, 30 shown abutting. The stone 20 has the length dimension of $L_1$ which is shown and indicated to the break line. Further, the stone 30 has a related depth dimension of $D_2$. In the depicted arrangement at corner 14, the stones 20, 30 are shown abutting and the stone 20 extends over the corner 14 by an amount equal to $D_2$. When the stone 30 is applied to the wall 12 at the same corner 14, the outer edges of the stones 20, 30 are aligned and the contours 29, 39 match.

Further, a dimension $D_L$ is defined that represents the total length $L_1$ less a depth $D_2$ of stone 30. The dimension $D_L$ is a number which is equal to a base number or a multiple thereof. The dimension $D_L$ provides that the dimensions of the stones remain consistent over the entire length of a row. For example, if the base number is two (inches), then the dimension $D_L$ may be two or a multiple thereof, matching the other stones of the row. The dimensional relationship of the set of stones, for example of one or more rows is maintained.

Referring now to FIG. 5, the corner arrangement of stones 20, 30 is depicted in a bottom view. When viewed from below, the stones 20, 30 are shown at the junction of the side surface 36 of stone 30 and the transition 23, similar to FIG. 4. In this view, the contours of the outward surfaces are shown substantially matching. This is depicted by matching contours 29, 39 which are aligned. More specifically, contours at the abutting surfaces are substantially matching. Therefore, the visibility of the seam 42 (FIG. 6) between stones 20, 30 is reduced.

With respect to FIGS. 4, 5, the contours 29, 39 are shown as convex or extending from the stones 20, 30. However, other embodiments may be provided wherein the contours are concave or where the surfaces 26, 36 are angled rather than curved. Still other embodiments may be provided where the texture of the surface matches at the seams. Accordingly, the ends of the stones 20, 30 may match in various manners to provide an improved seam between the stones 20, 30.

Further with regard to installation, the stones 20, 30 may be installed in the following manner. First, the stone 30 may be installed on the wall 12 at the corner 14. The abutting surface of stone 30 will be located at the corner and generally aligned with the surface of the wall 12 which is perpendicular to rear surface 35 of the stone 30. Next, the stone 20 is brought up against the stone 30 and the transition corner 23 is positioned toward the stone 30. When the surface 26 is aligned with the surface 36 of stone 30, the contours 29, 39 align and provide for improved appearance. Once the stones 20, 30 are in position, the distance from the inside corner to the ends of the stone is the base number or multiple of the base number. This is accomplished by making the stone with the transition corner, for example stone 20, have a length equal to a base number or multiple thereof plus a depth of the abutting stone, for example stone 30.

Figure 6:
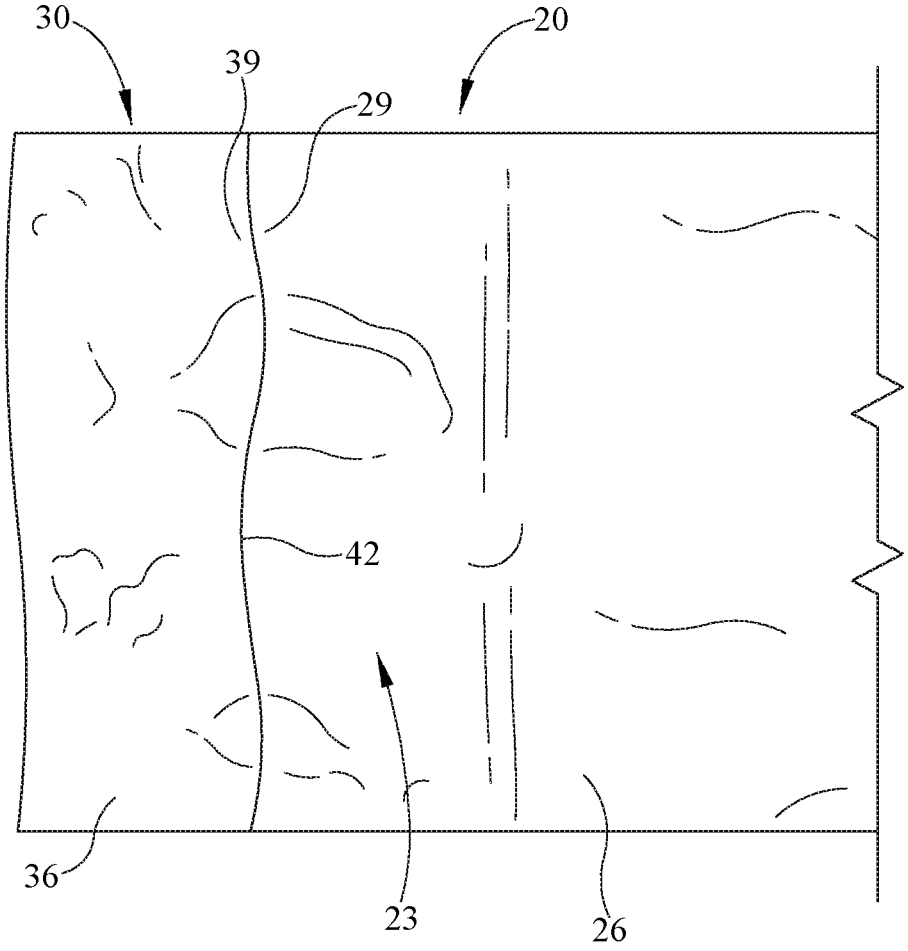
FIG. 6 is an end view of the position of corner location of FIGS. 4 and 5, depicting the contours in a perpendicular direction from that of FIG. 4; and, FIG. 7 is a perspective view of an alternative embodiment having a wall without a corner to which the artificial stones are applied.

Referring now to FIG. 6, the corner arrangement of stones 20, 30 is depicted in a side view, in a direction that is generally in the direction of the surface 36. In this view, the seam 42 wherein the stone 20, 30 are abutting is shown and the contours 29, 39 are matching along the seam 42.

With brief reference to FIG. 1 again, the stones are shown in opposite configurations. More specifically, the transition corner is shown on either side of the corner 14. This provides that a seam is not continuously extending down a single location of the corner and provides a more natural stone-like appearance. Further, the height of the stones at the corner 14 may vary as well as the length of the stones, to again provide a more realistic look.

Figure 7:
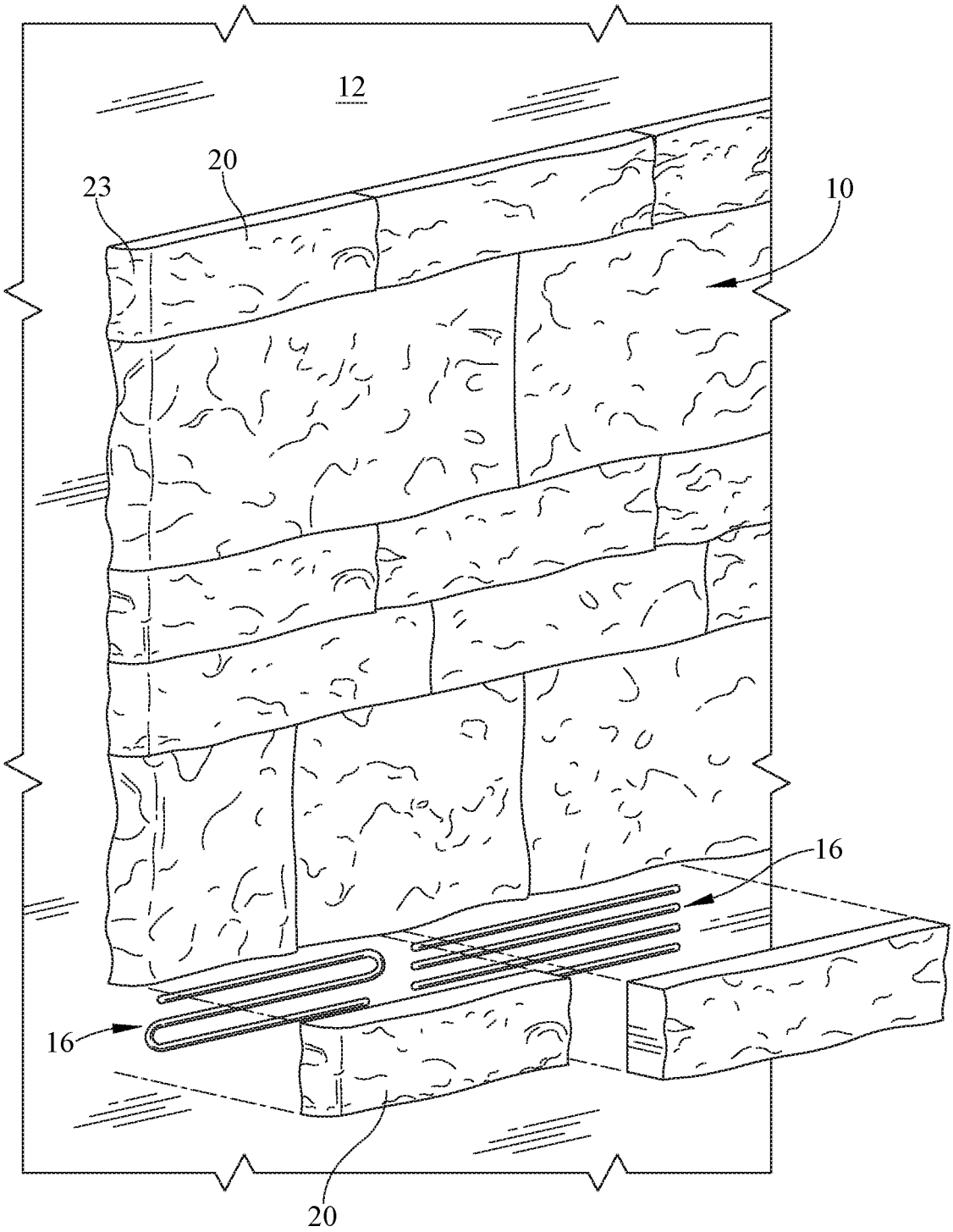

Referring now to FIG. 7, a perspective view of a wall 12 and artificial stone wall 10, including stone 20, is shown without a corner. The instant embodiment provides a further use which is unrelated to the corner embodiments. When stones, such as stone 20, are applied to the wall 12, the prior art may have resulted in an edge which had a prominent step from the wall 12 surface. The instant embodiment of stones allows for use of the transition corner to taper or curve from the wall 12. Thus, the edge of the veneer 10 is less prominent and such arrangement has a more desirable aesthetic appearance on a flat wall 12. The stones may be applied from the aligned edges of the transition corners and move away therefrom or the edges or two ends may be laid and the stones worked or installed toward a central location between the ends of the veneer 10. Also, shown are two stones which are exploded to depict the fixative 16 beneath. As previously described, the fixative may be applied in a variety of manners.

With reference to FIG. 1 again, as mentioned briefly previously, the relationship of the stone lengths may be related to the total length of each stone or it may be related to a differential between one stone and an adjacent stone in the same row or an adjacent row. As shown in the top row, stone 20 has a first length and stone 28 of an adjacent below row has a second length. The differential of the lengths is a base number, or may be a multiple thereof, such that the right hand ends of the stones 20, 28 are aligned. This allows for stone 40 to have a vertical edge which may abut the two rows containing stones 20, 28. This depicts that the stones may also have a relationship in a vertical direction wherein the height of stones may be a base number or some multiple of a base number. This allows for design of the stones to extend across one or more rows and therefore provide a more aesthetically appealing and natural appearance.

With reference to a lower row, stone 60 is shown with an adjacent stone 61 having a first length. Beneath stone 61 is stone 63 which has a shorter length. However, the differential of the lengths may be some base number, or a multiple thereof, such that one end of the stones 61, 63 is aligned vertically. This allows for alignment of an adjacent stone to extend across both rows, without any appreciable or a substantially limited gap between. With this description, one of skill in the art can understand that the length of the stones being a base number or multiple thereof, or alternatively the differential lengths of adjacent stones of adjacent rows being a base number or multiple of a base number, result in vertical alignment across at least two rows in some locations. At these locations, stones having a height which is two rows or some multiple thereof may be used to provide stones of varying height, and a more realistic stone appearance. Also, this allows for varying lengths of stones which minimizes the number of cuts so that a stone at the end of a row need only be cut to a final length which is dependent upon a length of the substrate 12.

As shown in the Figure, the stones may be of differing length but have a common base number, or multiple thereof, based on differential of length or based on length of the stones and the stones of aligned vertical edges may be at the corner 14 or along any of the rows spaced further or nearer to the corner 14.

While various embodiments have been described relative to use of artificial stone without mortar or grout, it should also be clear that this is not a limiting characteristic. The artificial stones may also be utilized with mortar or grout disposed between adjacent stones of a row or between stones of a row. Further, however, the use of a transition corner having a contoured outer surface may still be desirable since it may not be desirable to use mortar or grout between stones at the abutting corners. Still further, the use of mortar and grout may preclude the need for dimensional accuracies as described previously. Moreover, stone surfaces and edges may or may not be smooth and linearly precise as in other embodiments. Still further, if mortar and grout are used, it may also be desirable to mount the stones on lath, or utilize other materials common to traditional stone installations.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An artificial lightweight stone corner assembly, comprising:

a first lightweight molded stone having at least one first visible face which has a natural stone appearance and a first abutting corner end;

a second lightweight molded stone having at least one second visible face which has a natural stone appearance and a second abutting corner end;

said first and second abutting corner ends having substantially matching contours along respective abutting edges and one of said first or second opposing corner ends being a transition corner, said substantially matching contours defined by varying depth along a vertical dimensions of said first and second lightweight molded stones;

said transition corner having an outwardly facing surface and defined by said first visible face or said second visible face, wherein said transition corner is one of rounded, chamfered, or beveled, said transition corner having one of said abutting edges at said corresponding first or second abutting end, and wherein said transition corner transitions from one of said first visible face or said second visible face, to said abutting end of said corresponding abutting edge at an end of a flat rear surface of said first or second lightweight molded stone;

one of the first and second lightweight stones being asymmetrical due to said transition corner of the first or second visible face;

said first and second lightweight molded stones abutting one another at said first and second abutting corner ends, said natural stone appearance having said substantially matching contours at said edges where said first and second abutting corner ends meet and which reduces visibility of said abutting edges.

2. The artificial lightweight stone corner assembly of claim 1, said edges of said abutting corner ends being substantially matching.

3. The artificial lightweight stone corner assembly of claim 1, said abutting first and second lightweight molded stones defining an inside corner at rear surfaces of said abutting lightweight molded stones.

4. The artificial lightweight stone corner assembly of claim 3, said first lightweight molded stone having a first dimension from said inside corner to an end of said first stone.

5. The artificial lightweight stone corner assembly of claim 4, said second lightweight molded stone having a second dimension from said inside corner to an end of said second stone.

6. The artificial lightweight stone corner assembly of claim 5, said first dimension and said second dimension being a preselected base number or a multiple of a base number.

7. The artificial lightweight stone corner assembly of claim 1, said first and second lightweight molded stones each having an edge with said matching contours at said abutting corner ends.

8. The artificial lightweight stone corner assembly of claim 1, wherein at least one of said first or second stones and a third stone having a length differential which is a base number or a multiple of said base number.

9. The artificial lightweight stone corner assembly of claim 8 further comprising a seam of mortar or grout between a first row and a second row.

10. The artificial lightweight stone corner assembly of claim 8 further comprising mortar or grout between said seam pairs of said stones.

11. An artificial lightweight stone assembly, comprising:

a first faux lightweight stone having a first visible face with a natural stone appearance, said first visible face having a first corner end and a first abutting edge;

a second faux lightweight stone having a second visible face with a natural stone appearance, said second face having a second corner end with substantially matching contour as said first corner end, wherein one of said first corner end and said second corner end is a transition corner;

said transition corner having an outwardly facing surface defined by said second visible face and being one of curved, beveled, or chamfered and having said natural stone appearance between said second visible face and a second abutting edge at a flat rear surface of said second faux lightweight stone, said transition corner having said second abutting edge at said second corner end, and wherein said transition corner transitions from said second visible face to said edge at said second corner end;

further wherein when said first corner end of said first faux stone abuts with said second corner end of said second faux stone, said substantially matching contours of said first and second corner ends are aligned at said first and second abutting edges;

said second faux lightweight stone being asymmetrical due to said second visible face of said transition corner;

said substantially matching contours having varying depth along a vertical dimensions at said first and second edges of respective of said first corner end and said second corner end of said first and second stones thereby reducing visibility of said edges.

12. The assembly of claim 11, at least one of said first or second stones and said third stone having a length differential which is a base number or a multiple of said base number.

13. The assembly of claim 12, further comprising a fourth stone having a height which is at least a height of the sum of at least two rows.

14. The assembly of claim 13, said at least two rows having at least one location where a vertical edge is formed by two stones of said at least two rows.

15. The assembly of claim 14, said fourth stone located at said vertical edge.

16. The assembly of claim 11, further comprising an adhesive.

17. The assembly of claim 16, further comprising cement in said adhesive.

18. The assembly of claim 11 further comprising mortar or grout disposed between said faux lightweight stones and at least two rows.

19. A method of installing an artificial lightweight stone at a corner, comprising:

providing a first artificial lightweight stone having a transition corner, said transition corner which is one of rounded, chamfered, or beveled from a flat rear surface and a first abutting edge to an outer visible surface having a contour, said first stone being asymmetrical in shape due to said transition corner, said transition corner having said abutting edge at an abutting end, and wherein said transition corner transitions from said outer visible surface to said first abutting edge at said abutting end;

providing a second artificial lightweight stone having a corner end which matches said contour of said transition corner of said first artificial lightweight stone, each of said first and second artificial lightweight stones being on a first row;

positioning said second artificial lightweight stone on one of two substrates at a substrate corner;

positioning said first artificial lightweight stone on a second of said two substrates defining said substrate corner wherein said transition corner extends at least partially beyond said substrate corner and aligns with a second abutting edge of said second artificial lightweight stone;

abutting said second artificial lightweight stone with said transition corner of said first artificial lightweight stone, wherein said first artificial lightweight stone and said second artificial lightweight stone have substantially matching contours of varying depth along a vertical dimensions at a seam between said first abutting edge of said transition corner and said second abutting edge of said corner end in order to reduce visibility at said seam;

providing a third artificial lightweight stone and a fourth artificial lightweight stone in a second row, said third and fourth artificial lightweight stones oriented wherein said transition corner is positioned the other of said first and second substrates defining said substrate corner, opposite to said first and second artificial lightweight stones.

20. The method of claim 19, aligning said abutting edges of said first and second artificial lightweight stone.

* * * * *